US008346113B2

(12) United States Patent
Shibuya et al.

(10) Patent No.: US 8,346,113 B2
(45) Date of Patent: Jan. 1, 2013

(54) IMAGE FORMING APPARATUS INCLUDING A CLEANING MEMBER HAVING A BIAS VOLTAGE

(75) Inventors: Satoru Shibuya, Chiryu (JP); Hidetoshi Noguchi, Tahara (JP); Kazuyoshi Hara, Itami (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 307 days.

(21) Appl. No.: 12/720,449

(22) Filed: Mar. 9, 2010

(65) Prior Publication Data

US 2010/0232824 A1 Sep. 16, 2010

(30) Foreign Application Priority Data

Mar. 12, 2009 (JP) ..... 2009-059784

(51) Int. Cl.
*G03G 15/00* (2006.01)

(52) U.S. Cl. ..... 399/71; 399/99; 399/343; 399/353; 399/354

(58) Field of Classification Search ..... 399/71, 399/99, 343, 353, 354
See application file for complete search history.

(56) References Cited

U.S. PATENT DOCUMENTS

| | | | | |
|---|---|---|---|---|
| 5,606,408 | A * | 2/1997 | Yano et al. | 399/343 |
| 7,251,430 | B2 | 7/2007 | Nishikawa | |
| 7,630,658 | B2 | 12/2009 | Nishikawa | |
| 2003/0095808 | A1 | 5/2003 | Takami | |
| 2006/0039711 | A1 | 2/2006 | Shibuya et al. | |
| 2007/0286621 | A1 | 12/2007 | Nishikawa | |

FOREIGN PATENT DOCUMENTS

| | | |
|---|---|---|
| CN | 101046670 | 10/2007 |
| JP | 60-107684 | 6/1985 |
| JP | 2003-29552 | 1/2003 |
| JP | 2006-58422 | 3/2006 |
| JP | 2006-259092 | 9/2006 |
| JP | 2008-065355 | 3/2008 |

OTHER PUBLICATIONS

Extended European Search Report dated Jan. 26, 2011, directed towards counterpart application No. 10156198.3; 6 pages.
Chinese First Office Action mailed Jun. 16, 2011, directed to corresponding Chinese Application No. 201010139495.8; 10 pages.
Japanese Notification of Reasons for Refusal mailed Jan. 5, 2011, directed to counterpart Japanese Application No. 2009-059784; 6 pages.

* cited by examiner

*Primary Examiner* — Ryan Walsh
(74) *Attorney, Agent, or Firm* — Morrison & Foerster LLP

(57) ABSTRACT

An image forming apparatus comprises: a rotatable image carrier operable to carry a toner image on a surface thereof; a transfer part operable to electrostatically transfer the toner image carried on the surface of the image carrier, onto a transfer material; a cleaning member that is in contact with the surface of the image carrier and that is operable to clean toner remaining on the surface of the image carrier after transfer by the transfer part; and a voltage supplier operable to apply, to the cleaning member, a bias voltage that is for cleaning the surface of the image carrier and that has a polarity opposite to a normal charging polarity of the toner. Here, application of the bias voltage by the voltage supplier starts before rotation of the image carrier starts, and when $Vr>0$, $0<Vc<Vr$, and when $Vr<0$, $Vr<Vc<0$, where Vc is a value of the bias voltage from a start of the application until a start of the rotation, and Vr is a reference value which is a value of the bias voltage from the start of the rotation onward.

9 Claims, 5 Drawing Sheets

<Embodiment>

<Comparative example>

IMAGE FORMING APPARATUS INCLUDING A CLEANING MEMBER HAVING A BIAS VOLTAGE

This application is based on application No. 2009-059784 filed in Japan, the content of which is hereby incorporated by references.

BACKGROUND OF THE INVENTION (1) Field of the Invention

The present invention relates to an image forming apparatus that includes a rotatable image carrier and a cleaning member which is in contact with a surface of the image carrier.

(2) Related Art

Image forming apparatuses such as copiers that are able to form color images include so-called tandem-type image forming apparatuses. Tandem-type image forming apparatuses have a structure such as follows: photosensitive drums for colors of, for example, C (cyan), M (magenta), Y (yellow), and K (black) are arranged along an intermediate transfer belt; toner images formed on the photosensitive drums are primarily transferred in a sequential manner onto the surface of the rotating intermediate transfer belt to be superimposed at a same position; and the toner images for the respective colors primarily transferred onto the surface of the intermediate transfer belt are collectively secondarily transferred onto a recording sheet.

According to the above-described structure, it is desirable that the entirety of the toner images on the intermediate transfer belt is secondarily transferred onto the recording sheet. However, in reality, part of the toner images remains on the surface of the intermediate transfer belt without being transferred. Accordingly, a cleaning unit for cleaning the toner remaining on the intermediate transfer belt (residual toner) is provided at a position that is downstream, in the belt moving direction, relative to the secondary transfer position.

One example of such a cleaning unit is an electrostatic-adsorption type cleaning unit whose cleaning brush applied with a bias voltage abuts onto the surface of the intermediate transfer belt and which electrically removes the residual toner by adsorbing it to the cleaning brush. The residual toner adsorbed to the cleaning brush is collected by a collection roller provided adjacent to the cleaning brush.

In a case of using this electrostatic adsorption method, the residual toner remaining in the cleaning brush (attached to the bristles of the brush) cannot be kept attracted to the cleaning brush without application of a bias voltage to the cleaning brush. Accordingly, if the intermediate transfer belt is rotated without the application of the bias voltage, the bristles of the brush abutting the belt surface move mechanically due to the rotation of the intermediate transfer belt, and this movement causes the residual toner remaining in the brush to come out toward the belt surface, smearing the belt surface by attaching thereto. Thus, a control is performed such that the bias voltage is applied to the cleaning brush first, and after that, the rotation of the intermediate transfer belt starts. However, such a control, that is, applying the bias voltage to the cleaning brush when the intermediate transfer belt is not rotating, causes the bias voltage to be continually applied from the start of the voltage application until the start of the rotation of the intermediate transfer belt. This leads to accumulation of unnecessary electric charge at the intermediate transfer belt at its belt portion which abuts against the cleaning brush.

The cleaning unit may have a smoke prevention seal for preventing toner smoke provided at its end portion in the downstream in the belt moving direction; and in a vicinity positioned downstream relative to the cleaning unit in the belt moving direction, a filming preventive member made of foam sponge may be provided in contact with the surface of the intermediate transfer belt, in order to scrape off external additives and the like of the toner which the cleaning brush could not remove. Consequently, once the intermediate transfer belt starts rotating, when the belt portion having the unnecessary electric charge remaining thereon passes by the smoke prevention seal and the filming preventive member, the toner having been attached to the smoke prevention seal and the filming preventive member is attracted by the charge remaining at the belt portion and may move to the belt surface, smearing it as a result.

Such a problem occurs not only to intermediate transfer belts, but also may occur to structures having a cleaning member that electrically removes residual toner on an image carrier, such as a structure using a photosensitive drum as the image carrier.

SUMMARY OF THE INVENTION

The present invention aims to provide an image forming apparatus that is able to suppress smear on the surface of the image carrier, with a structure that electrically removes residual toner on the image carrier by applying a bias voltage to a cleaning member before rotation of the image carrier starts. The stated aim is achieved by an image forming apparatus comprising: a rotatable image carrier operable to carry a toner image on a surface thereof; a transfer part operable to electrostatically transfer the toner image carried on the surface of the image carrier, onto a transfer material; a cleaning member that is in contact with the surface of the image carrier and that is operable to clean toner remaining on the surface of the image carrier after transfer by the transfer part; and a voltage supplier operable to apply, to the cleaning member, a bias voltage that is for cleaning the surface of the image carrier and that has a polarity opposite to a normal charging polarity of the toner, wherein application of the bias voltage by the voltage supplier starts before rotation of the image carrier starts, and when $Vr>0$, $0<Vc<Vr$, and when $Vr<0$, $Vr<Vc<0$, where Vc is a value of the bias voltage from a start of the application until a start of the rotation, and Vr is a reference value which is a value of the bias voltage from the start of the rotation onward.

BRIEF DESCRIPTION OF THE DRAWINGS

These and the other objects, advantages and features of the invention will become apparent from the following description thereof taken in conjunction with the accompanying drawings which illustrate specific embodiments of the invention.

In the drawings.

DESCRIPTION OF THE PREFERRED EMBODIMENT

The following describes embodiments of an image forming apparatus by way of example of a tandem-type color digital printer (hereinafter, referred to as simply "printer").

First Embodiment

(1) Overall Structure of Printer

Figure 1:
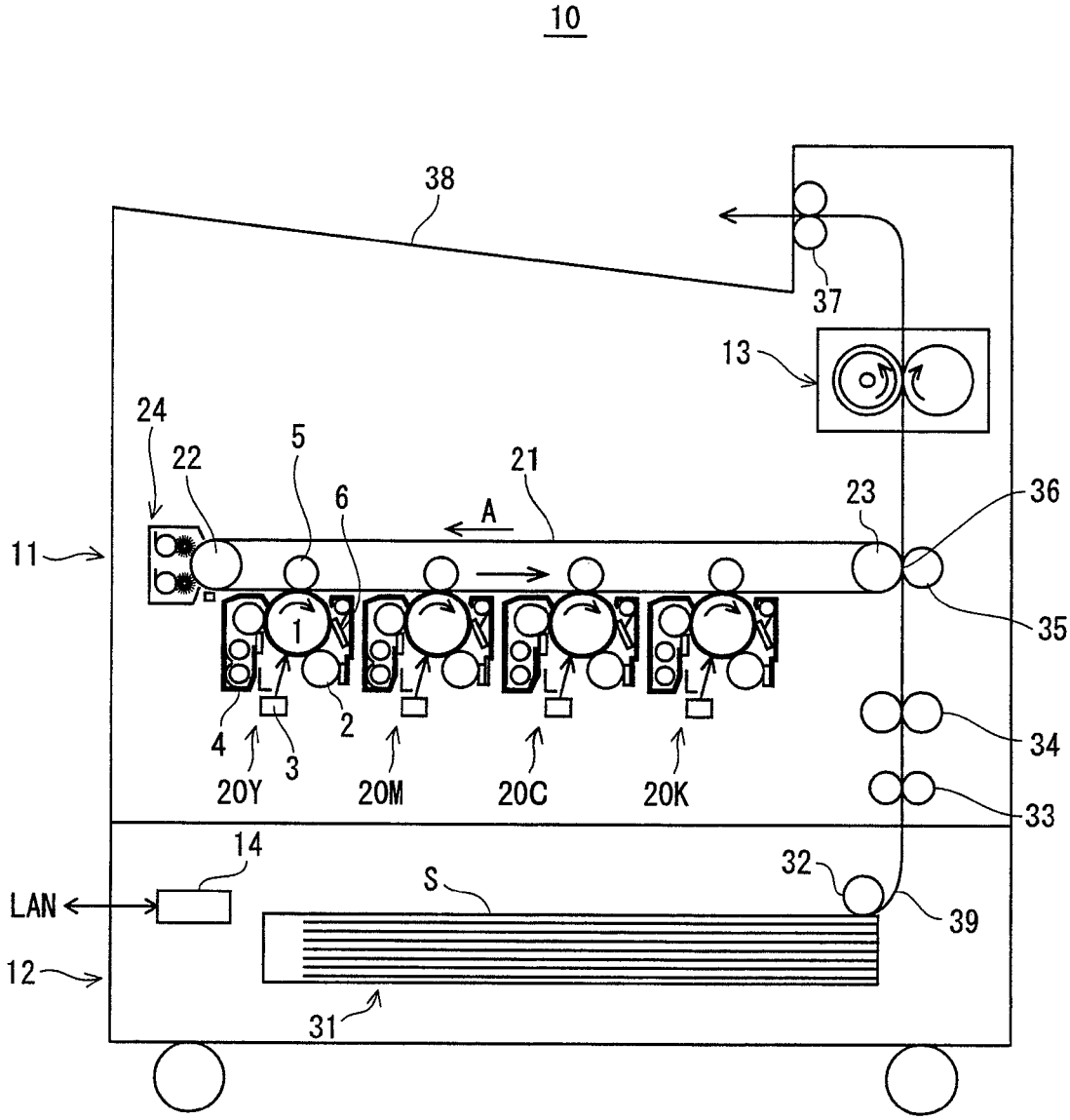
FIG. 1 shows an overall structure of a printer pertaining to a first embodiment.

FIG. 1 shows an overall structure of a printer 10.

As shown in FIG. 1, the printer 10 which executes image formation using a known electrographic system includes an image processing unit 11, a feeder 12, a fixing part 13, a controller 14, and the like. The printer 10 is connected to a network (e.g. LAN), and upon receiving a print job execution instruction from an external terminal apparatus (not shown), executes color image formation in accordance with the instruction, the color image being composed of colors yellow, magenta, cyan, and black. The yellow, magenta, cyan and black reproduction colors are hereinafter represented as Y, M, C, and K respectively, and the letters Y, M, C, and K are appended to numbers pertaining to the reproduction colors.

The image processing unit 11 includes image forming units 20Y, 20M, 20C, and 20K corresponding to the colors Y to K respectively, an intermediate transfer belt 21, and the like.

The image forming unit 20Y includes a photosensitive drum 1, and in a vicinity thereof, includes a charger 2, an exposing unit 3, a developer 4, a primary transfer roller 5, a cleaner 6 for cleaning the photosensitive drum, and the like, and forms a toner image in the color of Y on the photosensitive drum 1. The other image forming units 20M to 20K also have a similar structure to the image forming unit 20Y, and reference numbers thereof are omitted in FIG. 2.

Figure 2:
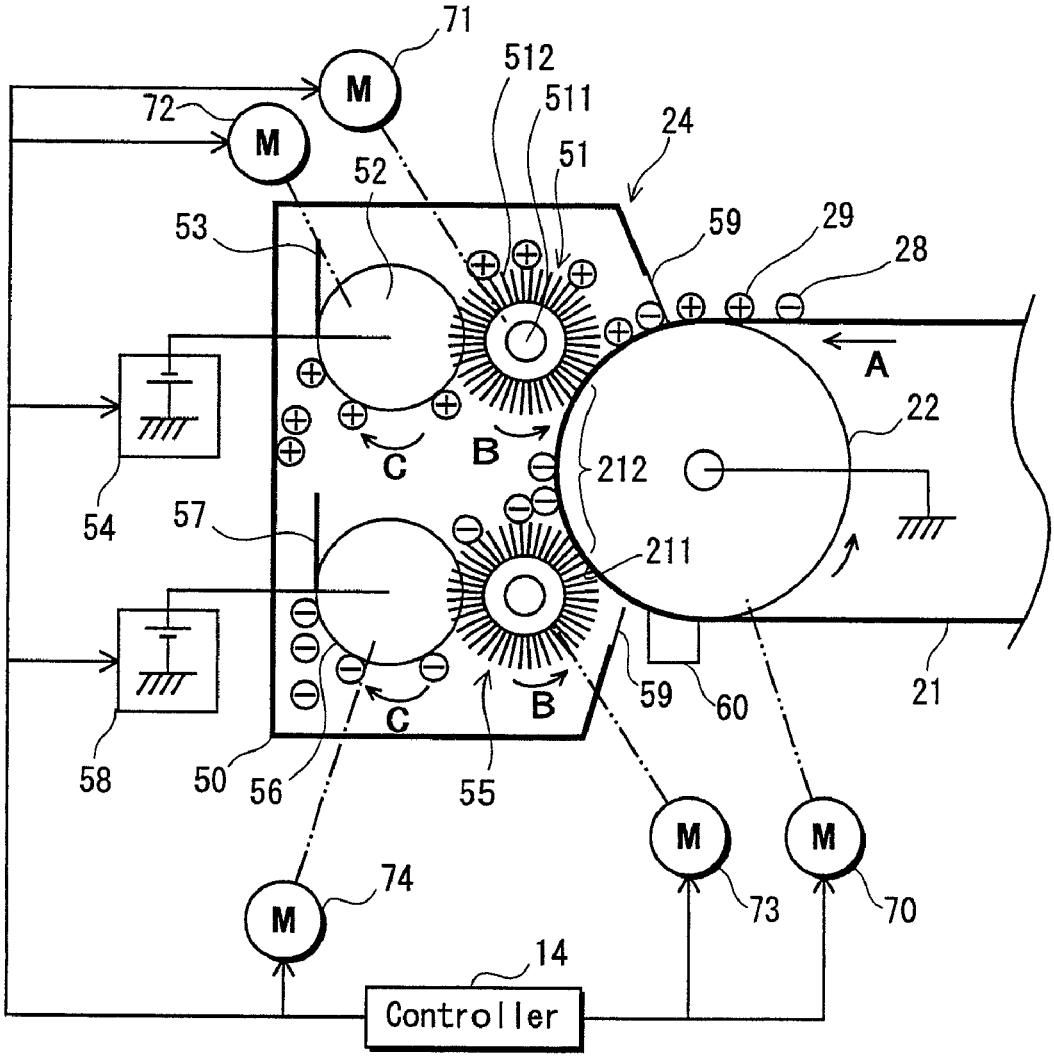
FIG. 2 shows an enlarged view of a structure of a cleaner provided in the printer.

The intermediate transfer belt 21 is an endless belt that is suspended in a tensioned state on a driving roller 22 and a driven roller 23, and is driven to rotate in the direction of arrow A in FIG. 1 by a drive force of a drive motor 70 (FIG. 2).

The feeder 12 includes: a sheet feed tray 31 accommodating sheets S as recording sheets; a feeding roller 32 which feeds the sheets S from the sheet feed tray 31 one sheet at a time toward a convey path 39; a convey roller pair 33 for conveying the fed sheets S on the convey path 39; a timing roller pair 34 for determining the timing to send the conveyed sheet S to a secondary transfer position 36; a secondary transfer roller 35 at the secondary transfer position 36 pressed against the driven roller 23 with the intermediate transfer belt 21 in between.

The fixing part 13 brings a fixing roller and a pressure roller in pressing contact with each other to secure a fixing nip, and heats the fixing roller to maintain a temperature required for fixing (e.g. 190° C.).

The controller 14 converts an image signal from the external terminal apparatus into digital signals for colors Y to K, and generates a driving signal for driving a laser diode arranged in the exposing unit 3 of each image forming unit.

The laser diode of the exposing unit 3 is driven in accordance with the generated driving signal, emits a laser beam L, and performs exposure scanning on the photosensitive drum 1. Prior to receiving this exposure scanning, the photosensitive drum 1 of each image forming unit is uniformly charged by the charger 2, and this exposure scanning by the laser beam L forms an electrostatic latent image on the surface of the photosensitive drum 1. The following explains an exemplary structure that uses a charging and exposing method according to which the photosensitive drum 1 is negatively charged by the charger 2, and a portion where an image is to be formed is exposed by the laser beam L.

Each electrostatic latent image is developed by the developer 4 with use of toner. Here, the toner whose normal charging polarity is negative is used, i.e., a reversal development method is used. The color toner images are primarily transferred onto the intermediate transfer belt 21 by electrostatic force acting between the primary transfer roller 5 and the photosensitive drum 1. For this primary transfer, the image forming operation for each color is executed at different timings so that the toner images are superimposed on the same position on the intermediate transfer belt 21. The toner images for each color that have been superimposed on the intermediate transfer belt 21 are transported to the secondary transfer position 36 by the rotation of the intermediate transfer belt 21.

Meanwhile, the sheet S is fed from the feeder 12 via the timing roller pair 34 in accordance with the timing of the image forming operations described above. The sheet S is conveyed sandwiched between the intermediate transfer belt 21 and the secondary transfer roller 35, and the toner images on the intermediate transfer belt 21 are collectively secondarily transferred onto the sheet S by electrostatic force acting between the secondary roller 35 and the driven roller 23.

The sheet S that has passed the secondary transfer position 36 is conveyed to the fixing part 13, and when the sheet S passes through the fixing nip, the toner images thereon are fixed thereto by heat and pressure. After that, the sheet S is discharged to a discharge tray 38 via a discharge roller pair 37. Residual toner remaining on a surface of the intermediate transfer belt 21 (hereinafter, referred to as "belt surface") without being secondarily transferred onto the sheet S is cleaned by the cleaner 24. The cleaner 24 is provided outside the rotation path of the intermediate transfer belt 21, and positioned downstream relative to the secondary transfer position 36 and upstream relative to the image forming unit 20Y in the belt moving direction (rotating direction).

(2) Structure of Cleaner 24

FIG. 2 shows an enlarged view of the structure of the cleaner 24, and also shows how residual toner on the belt surface is removed. In FIG. 2, residual toner 28 and residual toner 29 are shown as the residual toner. The residual toner 28 has a normal charging polarity, i.e. it is negatively charged; and the residual toner 29 has a polarity that is opposite to the normal polarity, i.e. it is positively charged. Here, the residual toner 29 is reversely charged instead of normally charged because of deterioration due to such as abrasion during agitation and the like and application of high voltages (positive polarity) during primary and secondary transfers. Most of the toner in the developer 4 is negatively charged in terms of toner charge distribution. However, although few in number, there are toner particles with a small charge amount (nearly zero) at a particular ratio, and these toner particles with such characteristics tend to remain on the belt surface as reversely charged residual toner. In general, the residual toner 29 charged with the opposite polarity and the residual toner 28 charged with the normal polarity are not close in ratio. However, in the figure, in order to clearly show how they are removed, the amounts of the both residual toner are indicated to have a similar ratio.

As shown in the figure, the cleaner 24 includes a first cleaning brush 51, a first collection roller 52, a first scraper 53, a first cleaning bias output part 54, a second cleaning brush 55, a second collection roller 56, a second scraper 57, a second cleaning bias output part 58, a smoke prevention seal 59, and the like.

The first cleaning brush 51 includes a core metal 511 which is a solid or hollow bar made of a metal conductive material, and a brush part 512 made of conductive brush fibers planted around the core metal 511. The brush part 512 is in contact with the belt surface. The core metal 511 is rotatably supported as a rotation axis by a housing 50 of the cleaner 24. The core metal 511 receives a driving force from a drive motor 71 via a drive transfer mechanism (not shown), and as a result, is driven to rotate (counter-rotate) in a direction of an arrow B which is opposite to the moving direction of the intermediate transfer belt 21.

The brush fibers are made of, for example, a material that includes a resin such as nylon, polyester, acryl, or rayon with carbon dispersed therein to provide conductivity. For example, the brush fibers each have a fineness of 1 D-10 D, a density of 50-300 [kF/inch$^2$], and a resistance of $10^5$-$10^{13}$ [Ω]. In addition, the brush fibers are set to bite into the belt surface by an amount of 0.5-2.0 [mm].

The first collection roller 52 is a solid or a hollow bar made of a metal, a conductive resin, or the like having conductivity. The first collection roller 52 is disposed opposing the intermediate transfer belt 21 via the first cleaning brush 51 and is in contact with the brush part 512 of the first cleaning brush 51. The first collection roller 52 is rotatably supported by the housing 50 of the cleaner 24. The first collection roller 52 receives a driving force from a drive motor 72 via a drive transfer mechanism (not shown), and as a result, is driven to rotate in a direction of an arrow C which is opposite to the rotating direction of the first cleaning brush 51. In order to reduce the friction resistance, processing such as abrasion, plating, or coating may be performed on the surface thereof. The first collection roller 52 is set to bite into the first cleaning brush 51 by an amount of 0.5-2.0 [mm].

The first scraper 53 is a blade-shaped member made of metal, rubber, or the like, and a tip thereof abuts against a circumferential surface of the first collection roller 52. The thickness, the press contact angle, the press contact force and the like of the first scraper 53 are set according to the type of the toner, the toner external additives, the material of the first collection roller 52, and the like.

The first cleaning bias output part 54 outputs a bias voltage that has the same polarity (negative) as the normal charging polarity of the toner. The output bias voltage is applied to the first cleaning brush 51 via the first collection roller 52. The application of this bias voltage creates a potential difference between the first cleaning brush 51 and the intermediate transfer belt 21, thereby forming an electric field therebetween that causes an electrostatic force to act on the reversely-charged toner in the direction from the intermediate transfer belt 21 toward the first cleaning brush 51. Being reversely charged, the residual toner 29 on the belt surface leaves the belt surface and is adsorbed to the brush part 512 of the first cleaning brush 51 due to the electrostatic force of the electric field and the toner-scraping force by the brush part 512.

Similarly, an electric field is formed between the first collection roller 52 and the first cleaning brush 51 due to a potential difference thereof, and the electric field causes an electrostatic force to act on the reversely-charged toner in the direction from the first cleaning brush 51 toward the first collection roller 52. As a result, the residual toner 29 adsorbed to the first cleaning brush 51 moves to the first collection roller 52 and is adsorbed to the circumferential surface thereof. The residual toner 29 adsorbed to the circumferential surface of the first collection roller 52 is scraped off from the circumferential surface of the first collection roller 52 by the first scraper 53, and is collected by a collector (not shown) of the housing 50.

The second cleaning brush 55, the second collection roller 56, and the second scraper 57 basically have a similar structure to the first cleaning brush 51, the first collection roller 52, and the first scraper 53, respectively. The second cleaning brush 55 is driven to rotate by a drive force of a drive motor 73, and the second collection roller 56 is driven to rotate by a drive force of a drive motor 74.

The second cleaning bias output part 58 outputs a bias voltage having a polarity (positive) that is opposite to the normal charging polarity of the toner. The output bias voltage is applied to the second cleaning brush 55 via the second collection roller 56.

The application of this bias voltage leads to an electric field formed between the intermediate transfer belt 21 and the second cleaning brush 55. The electric field causes an electrostatic force to act on the toner charged with the normal polarity in the direction from the intermediate transfer belt 21 to the second cleaning brush 55. Also, between the second collection roller 56 and the second cleaning brush 55, an electric field causing an electrostatic force to act in the direction from the second cleaning brush 55 to the second collection roller 56 is formed.

As a result, the residual toner 28 on the belt surface, which is charged to the same polarity as the normal charging polarity, leaves the belt surface and is adsorbed to the brush part of the second cleaning brush 55. The adsorbed residual toner 28 then moves to the second collection roller 56 and is adsorbed onto the circumferential surface thereof. The residual toner 28 adsorbed to the circumferential surface of the second collection roller 56 is then scraped off by the second scraper 57 and collected by the collector in the housing 50.

The smoke prevention seals 59 are attached to the housing 50 respectively at an upper portion and an lower portion of an opening facing the intermediate transfer belt 21, and prevent the collected residual toner from escaping out of the cleaner 24.

The filming preventive scraper 60 is provided outside the rotation path of the intermediate transfer belt 21. The filming preventive scraper 60 is positioned downstream relative to the cleaner 24 and upstream relative to the image forming unit 20Y in the belt rotation. The filming preventive scraper 60 is made of a flexible material having foam cells, such as polyurethane foam, urethane foam, a rubber sponge material, or the like. The filming preventive scraper 60 cleans the belt surface by scraping off the toner external additives and the like which the first and second cleaning brushes 51 and 55 could not remove, from the belt surface, and take them into its own foam cells. The filming preventive scraper 60 is set to have a thickness of 3-7 [mm], a density of 45-100 [kg/m$^3$], a hardness of 4-15 [kPa] (25% compressive hardness), a cell number of 40-120 [cell/25 mm], and a belt surface contact width of 8-20 [mm], and are set to bite into the belt surface by an amount of 0.5-2 [mm].

The following controls are executed by the controller 14: an output control on the upstream cleaning bias by the first cleaning bias output part 54 and an output control on the downstream cleaning bias by the second cleaning bias output part 58; a rotation control on the intermediate transfer belt 21 by the drive motor 70; a rotation control on the first and second cleaning brushes 51 and 55 by the drive motors 71 and 73; and a rotation control on the first and second collection rollers 52 and 56 by the drive motors 72 and 74.

(3) Details of Control of Bias Output and the Like by Controller 14

Figure 3A:
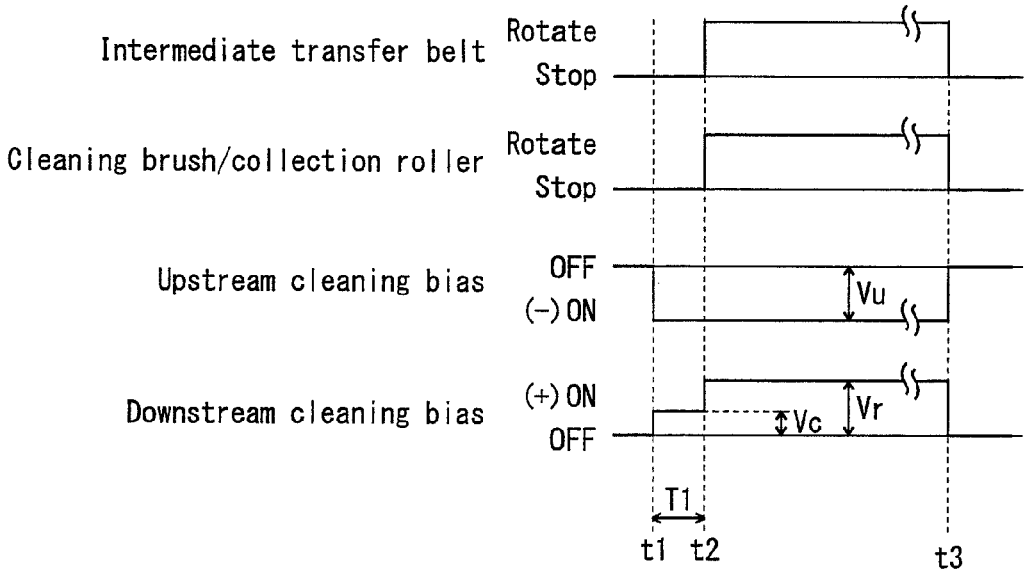
FIG. 3 is a timing chart showing control of a bias output and the like by a controller included in the printer.
Figure 3B:
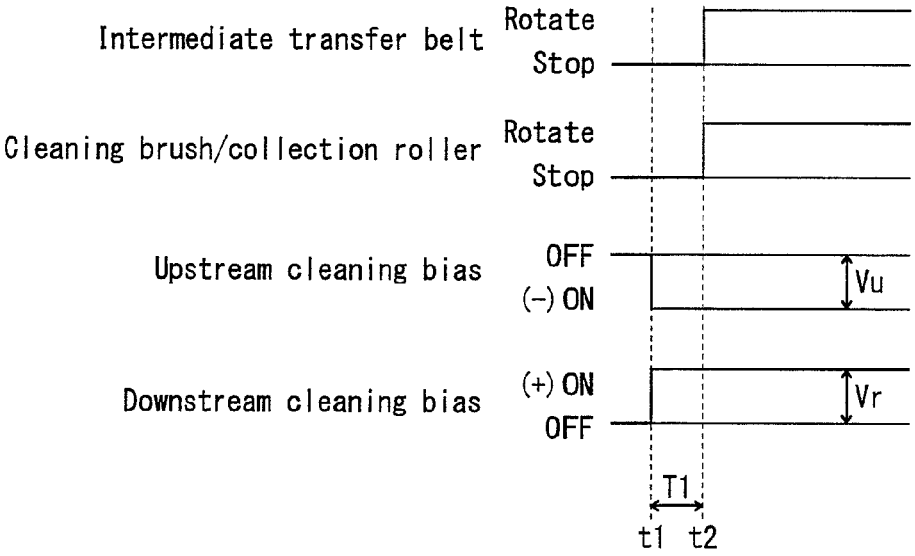

FIG. 3 are timing charts showing control of the bias output and the like by the controller 14; FIG. 3A shows the present embodiment, and FIG. 3B shows a comparative example.

As shown in FIG. 3A, the controller 14 first instructs the first cleaning bias output part 54 to output the upstream cleaning bias and instructs the second cleaning bias output part 58 to output the downstream cleaning bias (time point t1). At this time point t1, the intermediate transfer belt 21 is in a quiescent state (i.e. when the belt is not rotating). The voltage value of the upstream cleaning bias (the voltage value of the first cleaning brush 51) is Vu (negative), and the voltage value of the downstream cleaning bias (the voltage value of the second cleaning brush 55) is Vc (>0), which is lower than Vr (positive). For example, Vc=0.5×Vr.

Here, the value of Vu and the value of Vr are voltage values (reference values) appropriate for electrostatically removing the residual toner 28 and 29 from the belt surface of the intermediate transfer belt 21 by adsorbing the residual toner 28 and 29 on the belt surface while the intermediate transfer belt 21 is rotating.

Subsequently, at a time point t2 at which a predetermined time T1 has elapsed since the time point t1, the controller 14 causes the intermediate transfer belt 21, the first and second cleaning brushes 51 and 55, and the first and second collection rollers 52 and 56 to be driven to rotate by performing a control to drive the drive motors 70-74, and instructs the second cleaning bias output part 58 to switch the voltage value of the downstream cleaning bias from Vc to Vr.

The purpose of starting output of the upstream and the downstream cleaning biases while the intermediate transfer belt 21, the first and second cleaning brushes 51 and 55, and the like are in a quiescent state before starting rotation is, as described above, to attract the residual toner remaining in the brush to the brush, thereby preventing the residual toner in the brush from coming out of the brush and attaching to the belt surface.

Also, the purpose of keeping the voltage value of the downstream cleaning bias at Vc, which is lower than the reference value Vr, before the intermediate transfer belt 21 starts rotating is to prevent unnecessary electric charge from accumulating at the belt portion 211 (FIG. 2) in contact with the second cleaning brush 55 of the intermediate transfer belt 21, while the intermediate transfer belt 21 is in the quiescent state. Specifically, the unnecessary electric charge is prevented from accumulating in the following manner: the reference value Vr of the bias voltage is a value appropriate for efficiently removing the residual toner from the belt surface while the intermediate transfer belt 21 is rotating; however, application of the reference value Vr when the belt is not rotating causes the amount of electric charge (here, positive electric charge) provided to the belt portion 211 per unit time to be greater than the amount provided when the belt is rotating, resulting in accumulation of unnecessary electric charge; thus, when the belt is not rotating, the value of the bias voltage is kept lower than the reference value Vr to prevent an increase of unnecessary electric charge.

This structure suppresses, for example, a problem such as the following: when the belt portion 211 passes by the downstream-side smoke prevention seal 59 and the filming preventive scraper 60 after the intermediate transfer belt 21 starts rotating, the toner attached to these members is attracted by the electric charge remaining on the belt portion 211 and moves onto the belt surface, smearing the belt surface as a result.

The optimal value for the voltage value Vc of the cleaning bias is determined by experiments or the like. However, the lower limit and the higher limit thereof can be defined as follows. That is to say, the lower limit is the minimum value of a range of voltage that can keep the residual toner remaining at the brush part of the second cleaning brush 55 to the brush part (restrain the residual toner in the brush part) even when the intermediate transfer belt 21 or the second cleaning brush 55 rotates.

On the other hand, the upper limit is a maximum value of a range of voltage that does not attract the residual toner to the belt portion 211 to cause the residual toner to move to the belt surface, smearing the belt surface.

In the present embodiment, the value Vc is set as follows: Vc=0.5×Vr. This was determined empirically, and an example of an experiment is indicated below. In the experiment, the intermediate transfer belt 21 made of polyimide was used, and the brush fibers of the first and second cleaning brushes 51 and 55 were made of nylon, had a fineness of 2 D, a density of 240 [kF/inch$^2$], and a resistance of $10^{11.5}$ [Ω]. For both of the first and second cleaning brushes 51 and 55, the reference value Vr of the bias voltage=500 [V] and T1=40 [ms], and the downstream voltage value Vc was set to be 250 [V], which was the half of the reference value Vr.

For comparison, an experiment was conducted under the control shown in the comparative example (corresponding to the prior art) shown in FIG. 3B. As shown in FIG. 3B, in the comparative example, the voltage of the downstream cleaning bias was raised to the reference value Vr before the intermediate transfer belt 21 starts rotating, and this is the difference between the control shown in FIG. 3B and that shown in FIG. 3A.

Because the voltage value of the cleaning bias is constant at the reference value Vr, unnecessary electric charge tends to accumulate at the belt portion 211 under this control. Note that T1=60 [ms] in the comparative example. Here, the value of T1 is longer than that in the embodiment by 20 [ms]. This is because the voltage value of the cleaning bias rises from 0 to Vr=500 [V], which is higher than that of the embodiment, and accordingly, a longer time period is required for the rise.

In the experiment, the following judgment was made using an apparatus that executes image formation by performing a series of processing such as charging, exposing, developing, transferring, and fixing according to the electrophotographic system: the above-mentioned apparatus was equipped with the same members as the smoke prevention seal 59 and the filming preventive scraper 60 with a considerable amount of toner attached to these members, and it was judged whether the toner was secondarily transferred onto a sheet via the intermediate transfer belt 21 or not when print was executed in this condition. The result indicated that while the sheet was smeared with toner in the comparative example, there was no smear on the sheet in the embodiment.

Similar experiments were conducted repeatedly after replacing the intermediate transfer belt, the cleaning brush and the like with those of size, material, and so on that are often used in image formation apparatuses. As a result, it was found that setting the voltage values Vr and Vc to satisfy the following (Equation 1) can prevent toner smear.

$$0.2\times Vr<Vc<0.8\times Vr \quad \text{(Equation 1)}$$

The value of the voltage Vc can be set to an appropriate value within the range indicated by (Equation 1) depending on the apparatus configuration. Similar experimental results were obtained for the other embodiments, which are described later, as well. Note that while the above describes an example of a bias output control performed when the intermediate transfer belt 21 starts rotating, when the intermediate transfer belt 21 ends rotating, a control is performed in a manner that as shown in FIG. 3A, substantially simultaneously with the stopping of the intermediate transfer belt 21 (time point t3), the cleaning bias stops (is turned off), and the cleaning brushes and the collection rollers stop as well.

As described above, in the present embodiment, the voltage Vc of the cleaning bias, which has the polarity opposite to the normal charging polarity of the toner, is set lower before the intermediate transfer belt 21 starts rotating than the reference value Vr applied from the start of the rotation of the intermediate transfer belt 21. As a result, toner smear because of unnecessary electric charge remaining due to the cleaning bias of the intermediate transfer belt 21 can be prevented.

Second Embodiment

The embodiment above explains an exemplary structure that collects the reversely-charged (positive) residual toner 29 by electrostatic adsorption. The structure of the present embodiment differs from that of the above-described embodiment in the following aspect: a negative voltage is applied to the positively-charged residual toner 29, causing the residual toner 29 to be negatively-charged. Hereinafter, in order to avoid explanatory repetition, explanation of the same contents as those in the first embodiment is omitted, and the same structural elements are assigned the same reference signs.

Figure 4:
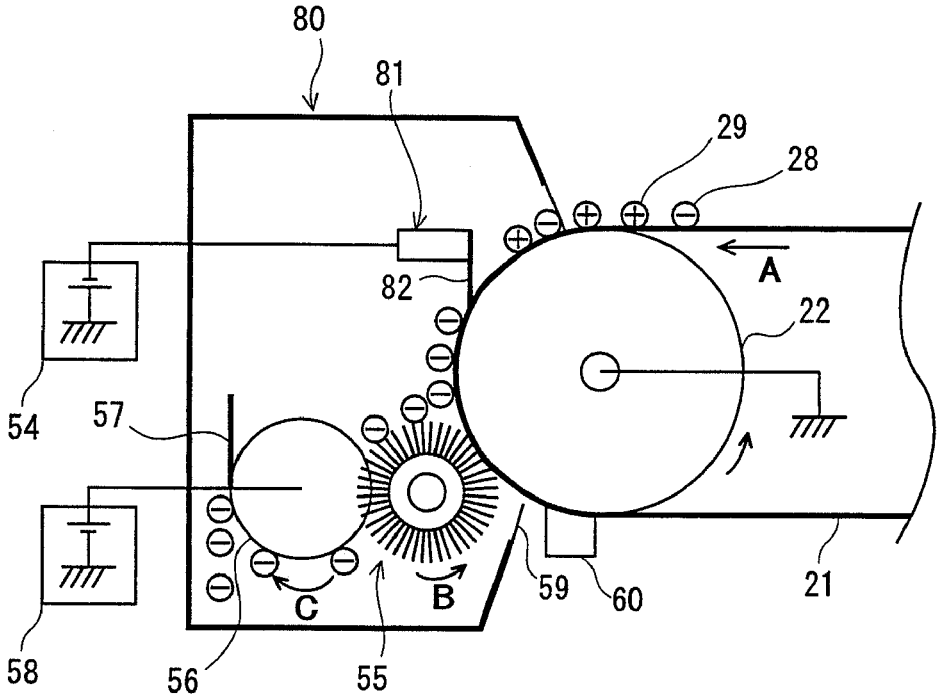
FIG. 4 shows a structure of a cleaner pertaining to a second embodiment.

FIG. 4 shows a cleaner 80 pertaining to the present embodiment.

As shown in FIG. 4, the cleaner 80 includes a charging brush 81, the first cleaning bias output part 54, the second cleaning brush 55, the second collection roller 56, the second scraper 57, the second cleaning bias output part 58, the smoke prevention seal 59, and the like.

The charging brush 81 is composed of a thin plate made of a conductive material such as a metal and a brush part 82 which is conductive and whose tip contacts the belt surface. More specifically, brush fibers or a base fabric with brush fibers weaved therein is attached to one surface of a thin-plate shaped conductive material, the longitudinal side of which lies in the axis direction of the drive roller 22. The brush part 82 is formed by the fibers that extending from the thin plate and lie in the axis direction of the drive roller 22. The brush fibers used for the brush part 82 is made of the same material as the brush part 512 of the first cleaning brush 51.

The charging brush 81 is applied with a negative cleaning bias output from the first cleaning bias output part 54, and the residual toner remaining on the belt surface is caused to uniformly have the negative charging polarity when the residual toner passes through the brush part 82, due to this negative cleaning bias. Specifically, the reversely (positively) charged residual toner 29 is changed to be negatively-charged; and the amount of electric charge of the normally (negatively) charged residual toner 28 increases.

The uniformly negatively-charged residual toner is adsorbed to the second cleaning brush 55 which is positioned downstream relative to the charging brush 81 in the belt moving direction, and is removed from the belt surface.

With a structure using the charging brush 81 described above also, toner smear can be prevented by switching the voltage of the cleaning bias applied to the second cleaning brush 55 between Vc and Vr at the above-described timings. Note that the charging brush 81 is not limited to brush-shaped, and, for example, can be a sheet-shaped, a roller-shaped, or a blade-shaped member with conductivity as long as it can cause the residual toner to have the same polarity as the normal charging polarity by providing the residual toner with a voltage having the same polarity as the normal charging polarity. Also, the charging brush 81 does not always need to be in contact with the belt surface; a wire with use of a corona discharge or a charger equipped with a saw-tooth electrode can be used instead.

Third Embodiment

In the above-described embodiments, the voltage value of the downstream cleaning bias is kept to Vc, which is lower than the reference value Vr, before the intermediate transfer belt 21 starts rotating, and is switched to Vr in synchronization with the start of the rotation of the intermediate transfer belt 21. The present embodiment differs from the embodiments above in the following aspect: the voltage Vc is maintained for a predetermined period of time even after the intermediate transfer belt 21 starts rotating, and switched to Vr' when the predetermined period of time has elapsed.

Figure 5:
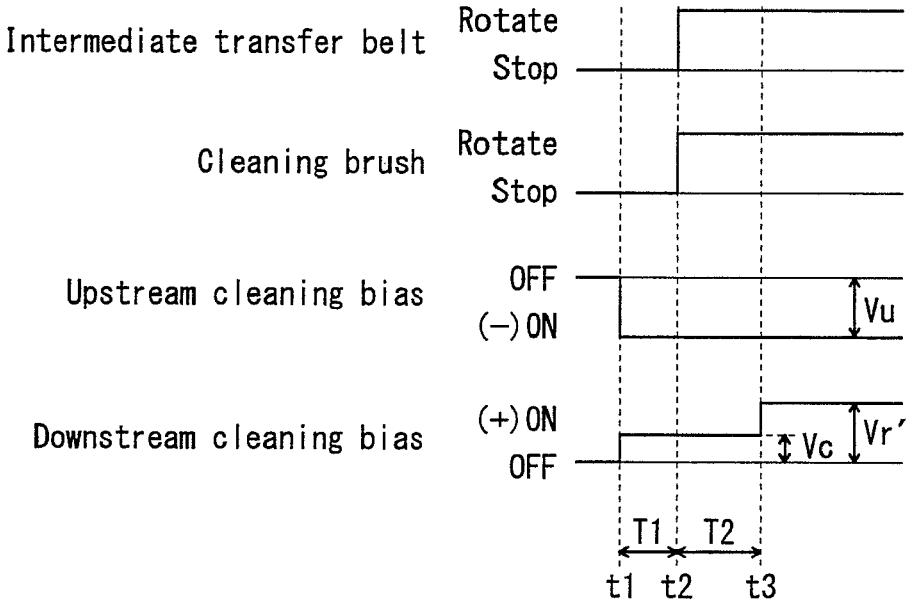
FIG. 5 is a timing chart showing switching of a downstream cleaning bias voltage pertaining to a third embodiment.

FIG. 5 is a timing chart showing switching of the downstream cleaning bias voltage pertaining to the present embodiment.

As shown in the figure, the value of the downstream cleaning bias is maintained at Vc even at and after t2 at which the intermediate transfer belt 21 starts rotating, and is switched to Vr' at t3 at which a predetermined period of time T2 has elapsed since the time point t2. The reason for maintaining the value of the downstream cleaning bias (positive) at Vc for the predetermined period of time T2 from the start of the rotation of the intermediate transfer belt 21, as described above, is as follows.

That is, depending on the apparatus configuration, a belt portion of the intermediate transfer belt 21 that has just passed the first cleaning brush 51 may have negative charge remaining thereon due to the cleaning bias of the first cleaning brush 51, and reaches the second cleaning brush 55 positioned downstream relative to the first cleaning brush 51, with the negative charge remaining thereon. In this case, setting a reference value of the downstream cleaning bias voltage (positive) to, for example, the reference value Vr of the first embodiment without taking the influence of the remaining negative charge into account leads to a decrease in the effect of the electrostatic adsorption by the positive charge in the downstream, due to the remaining negative charge.

Thus, when the structure is susceptible to the influence of the negative charge of the upstream cleaning bias, the reference value of the downstream cleaning bias voltage is pre-set to a value (Vr' according to the example in FIG. 5) that is higher than the reference value of a structure which is not susceptible to the negative charge (for example, the first embodiment), so as to compensate for the voltage fall due to the negative charge (i.e. adding the amount of voltage that is expected to fall due to the negative charge in advance).

By setting the reference value to a high value as described above, the belt portion of the intermediate transfer belt 21 where negative charge remains due to the first cleaning brush 51 in the upstream is maintained approximately at the reference value, i.e. the prescribed voltage, after the voltage fall due to the negative charge.

However, part of the intermediate transfer belt 21 does not receive the influence of the negative charge. Specifically, it is a portion from the first cleaning brush 51 to the second cleaning brush 55 in the belt moving direction (212 in FIG. 2) when the intermediate transfer belt 21 is in a quiescent state (from time point t1 to time point t2). There is no negative charge at the portion 212, and accordingly, application of the high voltage Vr' to the second cleaning brush 55 from the start of the belt rotation may cause positive charge to accumulate at the portion 212 due to the voltage being high even during the rotation of the intermediate transfer belt 21.

The belt portion 212 having positive charge remaining thereon may attract the toner attached to the seal 59, the filming preventive scraper 60, and the like, causing smear on the belt surface a result. Thus, the value of the bias voltage applied to the second cleaning brush 55 in the downstream is suppressed to Vc, which is the same as the voltage value applied when the belt is not rotating, for the time T2 (from t2 to t3) required for the belt portion 212 of the intermediate transfer belt 21 to pass through the second cleaning brush 55, in order to prevent the positive charge from accumulating. This predetermined time T2 is, for example, a value determined by dividing a circumferential length of the belt portion 212 (a distance on the belt surface in the belt rotating direction from the position where the belt is in contact with the first cleaning brush 51 to the position where the belt is in contact with the second cleaning brush 55) by a belt rotating speed.

As is apparent from the above, even with a structure where negative charge due to the upstream cleaning bias tends to accumulate, toner smear on the belt surface can be prevented by switching the voltage value of the downstream cleaning bias as described above.

It should be noted that although in the above, the voltage value of the downstream cleaning bias is set to be the same as the voltage value Vc applied when the belt is not rotating, it is not limited to this. An appropriate value depending on the apparatus configuration, such as a value between Vc and Vr or a value smaller than Vc can be used.

Fourth Embodiment

The embodiments above explain a structure where a switching control of the cleaning bias voltage is applied to the cleaner 24 which cleans the intermediate transfer belt 21. In the present embodiment, the switching control is applied to a cleaner which cleans the photosensitive drum, and the present embodiment differs from the embodiments above in this aspect.

Figure 6:
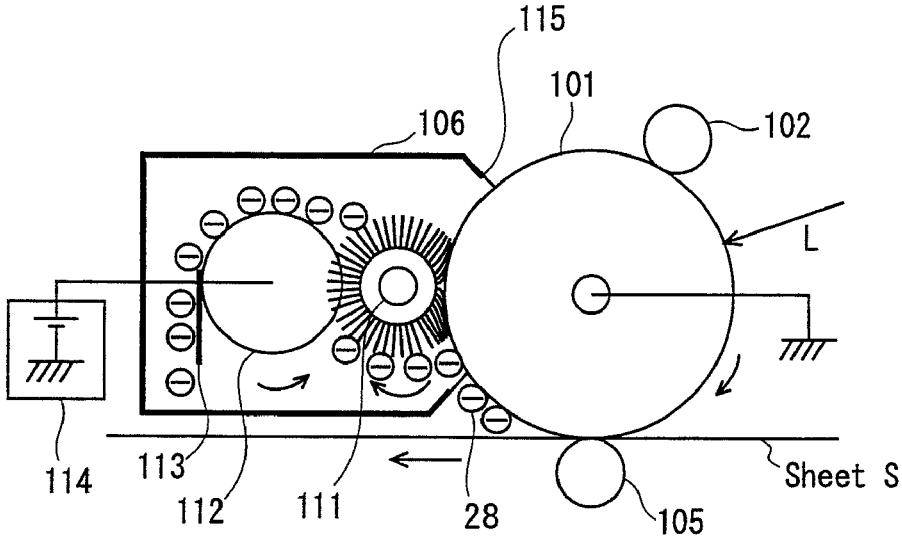
FIG. 6 shows an exemplary structure of a cleaner pertaining to a fourth embodiment.
Figure 7:
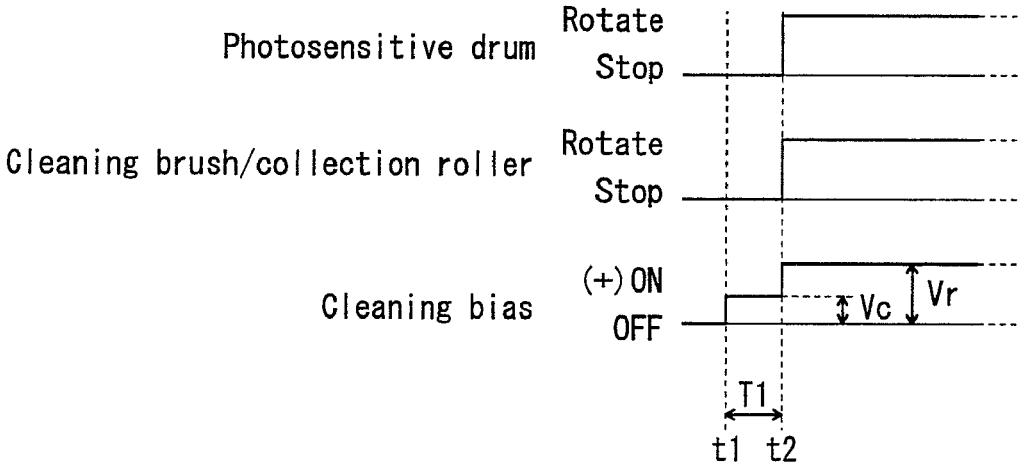
FIG. 7 is a timing chart showing switching of a cleaning bias voltage pertaining to the fourth embodiment.

FIG. 6 shows a cleaner 106 pertaining to the present embodiment, and FIG. 7 is a timing chart showing switching of a cleaning bias voltage pertaining to the fourth embodiment.

In FIG. 6, reference numeral 101 indicates a photosensitive drum, 102 indicates a charging roller, and 105 indicates a transfer roller. In the present embodiment, as in the above-described embodiments, a toner image is formed on the photosensitive drum 101 using the electrographic system, and the toner image formed on the photosensitive drum 101 is transferred onto a sheet S when the sheet S passes through the transfer nip between the photosensitive drum 101 and the transfer roller 105. Note that the exposing part and the developer are omitted in the figure.

The cleaner 106 cleans the residual toner 28 remaining on the photosensitive drum 101 after the transfer, and includes such as a cleaning brush 111, a collection roller 112, a scraper 113, a cleaning bias output part 114, and smoke prevention seals 115. These components basically have the same functions as the second cleaning brush 55, the second collection roller 56, the second scraper 57, the second cleaning bias output part 58, and the smoke prevention seals 59 of the first embodiment.

As shown in FIG. 7, first, a cleaning bias is output at the time point t1. The voltage value of the cleaning bias applied to the cleaning brush 111 is Vc (>0), which is lower than the reference value Vr. Here, the voltage value is suppressed to Vc for the same reason as cleaning the intermediate transfer belt 21 according to the structure of the embodiments above, that is, in order to prevent the following: if the voltage value of the cleaning bias is high, when the photosensitive drum 101 is in a quiescent state, unnecessary electric charge accumulates on the photosensitive drum 101 at a portion of its surface that is in contact with the cleaning brush 111; as a result, after the photosensitive drum 101 starts rotating, residual toner attached to the smoke prevention seal 115 is attracted to this accumulated charge, causing toner smear on the drum surface.

At the time point t2 at which the predetermined time T1 has passed since the time point t1, a drive motor (not shown) starts driving the photosensitive drum 101, the cleaning brush 111, and the collection roller 112 to rotate, and at the same time, the voltage value of the cleaning bias is switched from Vc to Vr.

As described above, by setting the voltage value of the cleaning bias to Vc, which is lower than the reference value Vr, before the photosensitive drum 101 starts rotating, and switching it to Vr when the photosensitive drum 101 starts rotating, toner smear on the surface of the photosensitive drum 101 can be prevented. It is also possible to apply the cleaner 106 in the present embodiment to the cleaner 6 of the first embodiment.

The present invention is not limited to image forming apparatuses and may be a control method for the cleaning bias voltage. Furthermore, the present invention may be a program for executing the control method on a computer. Also, the program pertaining to the present invention may be recorded to magnetic tape, a magnetic disk such as a flexible disk, an optical recording medium such as DVD-ROM, DVD-RAM, CD-ROM, CD-R, MO, or PD, or a computer-readable recording medium such as a flash-memory-type recording memory. The program may be produced and transferred in the form of the recording medium, and may also be transferred or distributed via telecommunication lines, radio communications, communication lines, or a network such as the Internet.

<Modifications>

Up to now, the present invention has been described based on the embodiments. However, it is obvious that the present invention is not limited to the above embodiments, and the following modifications can be implemented.

(1) According to the first embodiment above, the first cleaning brush 51 is positioned upstream relative to the second cleaning brush 55 in the belt moving direction. However, the structure is not limited to this, and for example, the second cleaning brush 55 may be positioned upstream relative to the first cleaning brush 51. Also, while in the embodiments above, the first and second cleaning brushes 51 and 55 are configured to rotate, they do not need to be configured to rotate. For example, blade-shaped components can be used. Furthermore, as the cleaning member, a roller whose surface is formed of conductive foam instead of a brush-shaped member may be used. One example of the foam is a resin material such as the rubber sponge material.

Furthermore, while the first and second cleaning brushes 51 and 55 are configured to bite into the belt surface by about a few millimeters, it is permissible as long as they are in contact with the belt surface. Also, the reversely-charged residual toner 29 can be cleaned according to the structure of the embodiments above; however, in a case of the apparatus configuration where reversely charged toner hardly occurs or even if it occurs, the amount is not large enough to incur toner smear, the first cleaning brush 51 in the upstream may not be equipped.

(2) Although the voltage value Vc of the cleaning bias is a constant value in the first embodiment, it is not limited to this. For example, a control may be performed in a manner that the value of Vc increases step-by-step or gradually rises. In other words, the voltage value Vc includes a meaning of a time-varying value. Also, in the first embodiment, the voltage value of the cleaning bias is Vc from the start of the application until the start of the rotation of the intermediate transfer belt 21, and is switched to Vr when the rotation starts. However, switching of the voltage value of the cleaning bias is not limited to when the rotation starts. The switching may be executed immediately before the start of the rotation as long as the effect of preventing toner smear is achieved. In other words, "until the start of the rotation" above includes a meaning of "until the switching immediately prior to the start of the rotation". These are similarly applicable to the other embodiments. Furthermore, (Equation 1) above does not always need to be satisfied as long as the effect of suppressing toner smear can be achieved while $0<Vc<Vr$ is satisfied.

(3) In the exemplary structures explained in the embodiments above, the normal charging polarity of the toner is negative (when $Vr>0$, $0<Vc<Vr$). However, for example, when toner whose normal charging polarity is positive is used, the polarities described above are all reversed, and the voltage values Vc and Vr are configured to satisfy the following relationships instead: $Vr<0$ and $Vr<Vc<0$. When the voltage value Vc of the cleaning bias is a variable value in this configuration, for example, the value of Vc may be controlled to fall step-by-step or gradually in the range of $Vr<Vc<0$.

The above-described embodiments describe an example where the image forming apparatus pertaining to the present invention is applied to a tandem-type color digital printer or the like. However, not limited to this, the image forming apparatus pertaining to the present invention can be applied to an image forming apparatus such as a copier, a FAX, a MFP (Multiple Function Peripheral) or the like regardless of whether the image formation is performed in color or monochrome, as long as the image forming apparatus electrostatically transfers a toner image carried on a surface of a rotatable image carrier onto a transfer material, and after the transfer, cleans toner remaining on the surface of the image carrier by electrically adsorbing the toner. In the above-described structure, if, for example, the image carrier is the photosensitive drum, the transfer material is the intermediate transfer belt; and if the image carrier is the intermediate transfer belt, the transfer material is the recording sheet. The image carrier is not limited to the photosensitive body or the intermediate transfer belt, and may be an intermediate transfer drum instead.

Also, the present invention may be any combination of the above embodiments and the modifications.

(4) Conclusion

The above-described embodiments and modifications indicate one aspect for solving the problem described in the Related Art section, and these embodiments and modifications can be summarized as follows.

One aspect of the present invention is an image forming apparatus comprising: a rotatable image carrier operable to carry a toner image on a surface thereof; a transfer part operable to electrostatically transfer the toner image carried on the surface of the image carrier, onto a transfer material; a cleaning member that is in contact with the surface of the image carrier and that is operable to clean toner remaining on the surface of the image carrier after transfer by the transfer part; and a voltage supplier operable to apply, to the cleaning member, a bias voltage that is for cleaning the surface of the image carrier and that has a polarity opposite to a normal charging polarity of the toner, wherein application of the bias voltage by the voltage supplier starts before rotation of the image carrier starts, and when $Vr>0$, $0<Vc<Vr$, and when $Vr<0$, $Vr<Vc<0$, where Vc is a value of the bias voltage from a start of the application until a start of the rotation, and Vr is a reference value which is a value of the bias voltage from the start of the rotation onward.

In the above-described image forming apparatus, the voltage supplier may switch the bias voltage from the value Vc to the reference value Vr substantially simultaneously with the start of the rotation.

The above-described image forming apparatus may further comprise: another cleaning member that is positioned either upstream or downstream relative to the cleaning member in a rotating direction of the image carrier and that is in contact with the surface of the image carrier, wherein before the start of the rotation, the voltage supplier applies, to the another cleaning member, a bias voltage having a same polarity as the normal charging polarity, for cleaning toner that remains on the surface of the image carrier and that is charged with the polarity opposite to the normal charging polarity.

The above-described image forming apparatus may further comprise: another cleaning member that is positioned upstream relative to the cleaning member in a rotating direction of the image carrier and that is in contact with the surface of the image carrier, wherein before the start of the rotation, the voltage supplier applies, to the another cleaning member, a bias voltage having a same polarity as the normal charging polarity, for cleaning toner that remains on the surface of the image carrier and that is charged with the polarity opposite to the normal charging polarity, and when a predetermined time has elapsed after the start of the rotation, the voltage supplier switches the bias voltage applied to the cleaning member from the value Vc to the reference value Vr.

In the above-described image forming apparatus, the predetermined time may be a value obtained by dividing, by a rotating speed of the image carrier, a distance on a circumferential surface of the image carrier in the rotating direction from a position where the another cleaning member is in contact with the circumferential surface to a position where the cleaning member is in contact with the circumferential surface.

The above-described image forming apparatus may form the toner image on a photoconductor by developing, with use of toner, an electrostatic latent image formed on the photoconductor in a rotating state, transfer the toner image formed on the photoconductor onto an intermediate transfer body in a rotating state, and transfer the toner image transferred onto the intermediate transfer body onto a sheet being conveyed, wherein either (i) the image carrier is the photoconductor and the transfer material is the intermediate transfer body or (ii) the image carrier is the intermediate transfer body and the transfer material is the sheet.

The above-describe image forming apparatus may further comprise: a charging member that is positioned upstream relative to the cleaning member in a rotating direction of the image carrier and that is operable to apply, to the toner remaining on the surface of the image carrier, a voltage having the same polarity as the normal charging polarity, thereby causing the toner to have the same polarity as the normal charging polarity.

In the above-described image forming apparatus, the cleaning member may be one of a conductive brush and a conductive foam roller.

In the above-described image forming apparatus, the value Vc of the bias voltage may be a constant value.

In the above-described image forming apparatus, when Vr>0, the value Vc of the bias voltage may be a variable value that rises step-by-step or gradually in a range of 0<Vc<Vr, and when Vr<0, the value Vc of the bias voltage is a variable value that falls step-by-step or gradually in a range of Vr<Vc<0.

As described above, by suppressing the bias voltage at the value Vc, which is lower than the reference value Vr, from the start of the voltage application until the start of the rotation of the image carrier, accumulation of unnecessary electric charge, while the image carrier is not rotating, at the portion of the image carrier in contact with the cleaning member can be inhibited. As a result, a conventional problem of toner smear occurring due to accumulation of unnecessary electric charge can be prevented.

INDUSTRIAL APPLICABILITY

The image forming apparatus pertaining to the present invention provides an effective technique, in a structure where residual toner on an image carrier is electrically removed, to suppress smear of the surface of the image carrier due to the residual toner.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

a rotatable image carrier operable to carry a toner image on a surface thereof;

a transfer part operable to electrostatically transfer the toner image carried on the surface of the image carrier, onto a transfer material;

a cleaning member that is in contact with the surface of the image carrier and that is operable to clean toner remaining on the surface of the image carrier after transfer by the transfer part;

another cleaning member that is positioned upstream relative to the cleaning member in a rotating direction of the image carrier and that is in contact with the surface of the image carrier; and a voltage supplier operable to apply, to the cleaning member, a bias voltage that is for cleaning the surface of the image carrier and that has a polarity opposite to a normal charging polarity of the toner, wherein application of the bias voltage by the voltage supplier starts before rotation of the image carrier starts, when Vr>0, 0<Vc<Vr, and when Vr<0, Vr<Vc<0, where Vc is a value of the bias voltage from a start of the application until a start of the rotation, and Vr is a reference value which is a value of the bias voltage from the start of the rotation onward, before the start of the rotation, the voltage supplier applies, to the another cleaning member, a bias voltage having a same polarity as the normal charging polarity, for cleaning toner that remains on the surface of the image carrier and that is charged with the polarity opposite to the normal charging polarity, and when a predetermined time has elapsed after the start of the rotation, the voltage supplier switches the bias voltage applied to the cleaning member from the value Vc to the reference value Vr.

2. The image forming apparatus of claim 1, wherein the voltage supplier switches the bias voltage from the value Vc to the reference value Vr substantially simultaneously with the start of the rotation.

3. The image forming apparatus of claim 1 further comprising:

another cleaning member that is positioned either upstream or downstream relative to the cleaning member in a rotating direction of the image carrier and that is in contact with the surface of the image carrier, wherein before the start of the rotation, the voltage supplier applies, to the another cleaning member, a bias voltage having a same polarity as the normal charging polarity, for cleaning toner that remains on the surface of the image carrier and that is charged with the polarity opposite to the normal charging polarity.

4. The image forming apparatus of claim 1, wherein the predetermined time is a value obtained by dividing, by a rotating speed of the image carrier, a distance on a circumferential surface of the image carrier in the rotating direction from a position where the another cleaning member is in contact with the circumferential surface to a position where the cleaning member is in contact with the circumferential surface.

5. The image forming apparatus of claim 1 that forms the toner image on a photoconductor by developing, with use of toner, an electrostatic latent image formed on the photoconductor in a rotating state, transfers the toner image formed on the photoconductor onto an intermediate transfer body in a rotating state, and transfers the toner image transferred onto the intermediate transfer body onto a sheet being conveyed, wherein either (i) the image carrier is the photoconductor and the transfer material is the intermediate transfer body or (ii) the image carrier is the intermediate transfer body and the transfer material is the sheet.

6. The image forming apparatus of claim 1 further comprising:

a charging member that is positioned upstream relative to the cleaning member in a rotating direction of the image carrier and that is operable to apply, to the toner remaining on the surface of the image carrier, a voltage having the same polarity as the normal charging polarity, thereby causing the toner to have the same polarity as the normal charging polarity.

7. The image forming apparatus of claim 1, wherein the cleaning member is one of a conductive brush and a conductive foam roller.

8. The image forming apparatus of claim 1, wherein the value Vc of the bias voltage is a constant value.

9. The image forming apparatus of claim 1, wherein when Vr>0, the value Vc of the bias voltage is a variable value that rises step-by-step or gradually in a range of 0<Vc<Vr, and when Vr<0, the value Vc of the bias voltage is a variable value that falls step-by-step or gradually in a range of Vr<Vc<0.

* * * * *